United States Patent [19]

Takahashi et al.

[11] 4,144,142

[45] Mar. 13, 1979

[54] METHOD FOR PRODUCING COLORED ANODIC FILM ON ALUMINUM-BASED MATERIAL

[75] Inventors: Toshiro Takahashi; Masashi Ikegaya; Masamichi Ozaki, all of Shizuoka, Japan

[73] Assignee: Riken Keikinzoku Kogyo Kabushiki Kaisha, Shizuoka, Japan

[21] Appl. No.: 857,412

[22] Filed: Dec. 5, 1977

Related U.S. Application Data

[63] Continuation of Ser. No. 628,753, Nov. 4, 1975, abandoned.

[51] Int. Cl.[2] ..... C25D 11/08; C25D 11/14; C25D 11/30

[52] U.S. Cl. ..... 204/58

[58] Field of Search ..... 204/58

[56] References Cited

U.S. PATENT DOCUMENTS 3,836,439 9/1974 Ikegaya et al. ..... 204/58

FOREIGN PATENT DOCUMENTS 1090840 11/1967 United Kingdom ..... 204/58

*Primary Examiner*—R. L. Andrews

*Attorney, Agent, or Firm*—Finnegan, Henderson, Farabow & Garrett

[57] ABSTRACT

A method for inexpensively producing a colored anodized film on aluminum or aluminum alloy material by electrolyzing the aluminum material in a sulphuric acid bath in the presence of a resistivity agent selected from trivalent aluminum ions and oxalic acid, by applying thereto a pulsating electric current having a peak voltage of 25 to 45 volts and a pulse duration of 5 to 70 milliseconds (m.sec.) and a ratio of pulse frequency to pulse duration of between 2 and 7.

2 Claims, 1 Drawing Figure

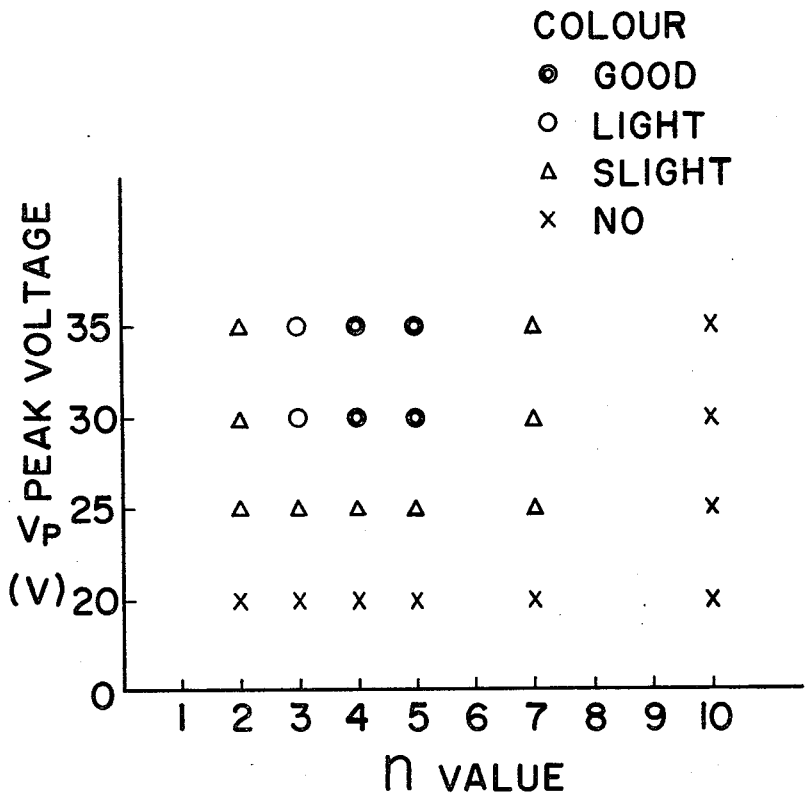
COLOUR
GOOD
LIGHT
SLIGHT
NO
$V_P$ PEAK VOLTAGE (V)
35
30
25
20
0
1 2 3 4 5 6 7 8 9 10
n VALUE

METHOD FOR PRODUCING COLORED ANODIC FILM ON ALUMINUM-BASED MATERIAL

This is a continuation of application Ser. No. 628,753, filed 11-4-75, now abandoned.

The present invention relates to a method for producing coloured anodic films on aluminum or aluminum alloy products. More particularly, the present invention pertains to a method for producing coloured anodic films by using sulphuric acid electrolyte.

It has already been known and widely used in industry to produce coloured anodic films on the surfaces of aluminum or aluminum alloy products (hereinafter simply referred to as "aluminum products") by means of electrolytic processes. It has also been known that, in producing a colour in anodized film, the electric voltage applied in the process has an important effect on the nature of the colour. It is usually believed that an increase in the applied voltage provides a film colour of better quality. In an electrolytic process in which organic acid or mixed acid is used as the electrolyte, an electric voltage of 40 to 70 volts is desirable to obtain a coloured film of good quality.

However, in a process in which sulphuric acid is employed as the electrolyte, an increased conductivity of the electrolyte permits an increased amount of electric current to flow therethrough, so that it is practically difficult to increase the voltage above 20 volts without affecting uniformity of the produced film.

Therefore, in a process using sulphuric acid as the electrolyte, an electric voltage of less than 20 volts is applied. In this process, however, colour is not produced in the anodized film and the film thus produced is of pure transparent nature so that the silver colour of the base aluminum is seen through the film.

It has been proposed to obtain an anodized film of a certain colour such as gray or amber through an electrolytic process using less expensive sulphuric acid and applying electric voltage exceeding 20 volts. Although anodized film thus deposited is capable of producing a coloured coating, it suffers from a lack of uniformity due to the presence of locally produced tan coloured spots in the film.

For example, U.S. Pat. No. 2,930,741 issued to Burger et al. discloses passing a pulsating direct current through an aqueous electrolyte containing a solution of ammonium borate and boric acid, it does not teach either the use of a sulfuric acid containing electrolyte or the particular pulsating voltages used in the instant invention.

Therefore, the present invention has as an object to provide a method for producing a uniformly coloured anodized film by means of an electrolytic process using sulphuric acid electrolyte.

Another object of the present invention is to provide a method for producing coloured anodic films on aluminum products dipped in sulphuric acid electrolyte by applying high voltage pulses of a predetermined duration to the products.

A further object of the present invention is to provide a method for producing coloured anodic films on aluminum products dipped in sulphuric acid electrolyte by adding a resistivity control agent to the electrolyte so as to make it possible to perform the process with low current, high voltage pulses for improving the colour and other properties of the anodized film.

A still further object of the present invention is to provide a method for producing coloured anodic film with a decreased processing time.

A still further object of the present invention is to provide a method for producing coloured anodic film on aluminum materials containing selected elements therein in order to form a wide range of colour tones of the oxidized coatings.

According to the present invention, the above and other objects can be accomplished by a method comprising applying voltage pulses having a peak voltage of 25 to 45 volts and a pulse duration of 5 to 70 m.sec. to aluminum or aluminum alloy products in sulphuric acid electrolyte. According to a further and preferable feature of the present invention, the ratio of the pulse frequency to the pulse duration (hereinafter referred to as n-value) is between 2 and 7. According to a further feature of the present invention, it is also preferable that the average current density is between 2 and 8 A/dm$^2$.

Thus, according to the present invention, the aluminum or aluminum alloy members or products are formed with uniformly coloured anodized film by a method comprising steps of cleaning the product by degreasing and washing operations, dipping it into an electrolyte containing 8 to 30 weight percent, preferably 10 to 15 weight percent of sulphuric acid, and applying the following pulse voltage (without the base voltage) in such a manner that an electrolytic process is performed with the aluminum acting as an anode:

| | | |
|---|---|---|
| peak voltage: | above 25 volts | (preferably 30–45V) |
| pulse duration: | 5 to 70 m.sec. | (preferably 10–45 m.sec) |
| pulse frequency/pulse duration (n-value): | 2 to 7 | (preferably 3–5) |
| average current density: | 2 to 8 A/dm$^2$ | (preferably 3–6 A/dm$^2$) |

It is recognized that colour is produced in the anodized film formed in accordance with the process of the present invention due to the fact that abrupt voltage pulse is applied to aluminum alloy materials during the electrolytic process so that imperfect oxidation takes place during production of anodized films resulting in formation of suboxides such as AlO and $Al_2O$, and that reduced sulphuric acid ion is allowed to enter the lattice structures of the anodized films.

It has been found that with a pulse duration of less than 5 m.sec., there is a substantial decrease in the efficiency of anodized film formation and, with the pulse duration exceeding 70 m.sec., the formation and colouring of the anodized film become out of balance.

It has been found that the peak voltage less than 25 volts is not sufficiently large to colour the oxidized film, and with the voltage pulse exceeding 25 volt, dark and varied colours are obtained. However, application of peak voltages exceeding 45 volts to the aluminum material being coloured is not recommended because voltages in excess of 45 volts cause local tanning and cracking of the anodized film.

With the "n-value" exceeding 7, the rising of the pulse becomes so steep that the anodized film is subjected to voltage shocks and cracks may be produced in the film. Further, when the "n-value" is lower than 2, there may be excessive current so that only a slight colour, if any, is produced in the film.

It has also been found that preferable results can be obtained with the peak voltage of 30 to 45 volts, the "n-value" of 3 to 5, the average current density of 3 to 6 $A/dm^2$ and the pulse duration of 10 to 50 m.sec.

In order to obtain more than 35 volts of voltage drop across the electrolyte, a conductivity or resistivity control agent can be added to the electrolyte. Conductivity or resistivity control agents that can be used in the present invention include materials that cause an increase in viscosity of the electrolyte, such as glycerin, dissolved aluminum (aluminum ion $Al^{+++}$) or oxalic acid. By using such a control agent, it becomes possible to increase the electric resistance of the electrolyte to such a value that it allows an increase in the applied voltage without increasing electric current. With addition of suitable agent, it is possible to increase the voltage as high as 65 volts, however, it is preferable to maintain the voltage below 45 volts.

According to the method of the present invention, it is possible to eliminate the etching pretreatment step which has conventionally been employed by using NaOH. Therefore, according to the method of the present invention, it is possible to avoid a loss of metal which has hithertofore been experienced in the etching step. In the method of the present invention, an etching effect is obtained during the electrolytic process in the sulphuric acid solution.

With average current density which is outside the aforementioned range, there is a substantial decrease in the efficiency of the anodized film formation. When the electrolyte includes less than 8 percent by weight of sulphuric acid, there are formed an appreciable number of pits or pores in the film and, when the sulphuric acid content is greater than 30 percent by weight, the film may be dissolved resulting in poor appearance.

Further, in order to create a wide range of colour tones, it is possible to control the ratio of Zn to Mg in the aluminum material. When the ratio of Zn to Mg is not greater than 5, a gold like colour is produced on the aluminum material.

In the above description, the voltage pulses have been applied in such a manner that the aluminum materials function as anodes. However, it should be noted herein that, by applying voltage pulses of which the polarity alternately changes, it is possible to have the aluminum materials function as both anode and cathode.

The present invention will hereinafter be described by way of examples.

EXAMPLE 1

Samples of aluminum alloy A6063 were dipped in a bath containing 13.2 percent by weight of sulphuric acid at a temperature of 50° C. for 5 minutes. After washing in a flow of water, they were neutralized by a conventional method and again washed in a flow of water. Thereafter, the aluminum members were subjected to an electrolytic process for 30 minutes in a bath of 15 weight percent water solution of sulphuric acid under several different conditions shown in Table 1. The results are also shown in the Table.

DESCRIPTION OF THE DRAWING

The influences of the n-value and the peak voltage on the colours of the anodized films as shown in Table I are illustrated in FIG. 1.

Table I

| Process Data | | Colour of Anodized Film | | |
|---|---|---|---|---|
| n-value | Peak Voltage Pulse Duration | 25 | 30 | 35 |
| 2 | 15 | | | light gray |
| | 50 | | light gray | gray |
| 3 | 15 | light amber | medium amber | amber |
| | 50 | medium amber | amber | amber |
| 4 | 15 | medium amber | amber | rich amber |
| | 50 | amber | rich amber | rich amber |
| 5 | 15 | medium amber | amber | rich amber |
| | 50 | amber | rich amber | rich amber |
| 7 | 15 | | light amber | light amber |
| | 50 | | light amber | light amber |

EXAMPLE 2

Sample of aluminum alloy A6063 were pretreated as in the Example 1 and subjected to electrolytic process under the conditions shown in Table II. The results are also shown in the Table.

Table II

| Process Data Current | Electrolyte (wt. %) | Current Density ($A/dm^2$) | Voltage (V) | Temp. (° C) | Pulse Duration m sec. | n-Value | Film colour |
|---|---|---|---|---|---|---|---|
| DC | $H_2SO_4$ 15 | 1 | 15 | 20 | | | |
| Pulse | $H_2CO_4$ 15 | 6 | 35 | 10 | 50 | 5 | Rich amber |

The anodized films obtained as shown in Table II both through the DC process and the process in accordance with the present invention were subjected to several duration tests. The results are shown in Table III.

In Table III, it will be noted that the anodized film as obtained by the process of the present invention is superior in various properties to that obtained by the DC process and, since the former is coloured, it is considered to be superior.

Table III

| Test Item | Test Results | |
|---|---|---|
| | DC Process | Invention |
| Corrosion Resistant Property (Cass test) | R.N = 9 | R.N = 9 |
| Corrosion Resistant Property (Alkali Drip) | 5 sec/μ | 7 sec/μ |
| Heat Resistant Property (Cycle Test) | — | *E = 1.1 NBS |
| Weather Test (Dew Cycle Test) | | *E = 0.7 NBS |
| Hardness (Vickers) | 222 to 370 Hv | 290 to 420 Hv |
| Wear Resistant (SAND TEST) | 60 sec/ | 90 sec/ |

*The change of colour through the test is shown by the difference of colour (E).

EXAMPLE 4

Samples of aluminum alloy A6063 were pretreated as in Example 1 and subjected to electrolytic processes in the bath containing 15 weight percent of sulphuric acid for 30 minutes under the conditions shown in Table IV. The results are also shown in the Table.

Table IV

| Sample | Bath Temp. (° C) | Pulse Duration | n | Peak Voltage (V) | Average Current Density (A/dm²) | Film Thickness (μ) | Colour |
|---|---|---|---|---|---|---|---|
| 1 | 15 ± 2 | 16 | 2 | 35 | 4.15 | 60 | slightly light amber |
| 2 | 15 ± 2 | 16 | 3 | 35 | 4.42 | 47 | amber |
| 3 | 15 ± 2 | 16 | 4 | 35 | 2.79 | 42 | slightly rich amber |
| 4 | 15 ± 2 | 33 | 2 | 35 | 4.86 | 64 | amber |
| 5 | 15 ± 2 | 33 | 3 | 35 | 3.90 | 40 | slightly rich amber |

Examples in which resistivity control agents are applied to sulphuric acid electrolyte will hereinafter be described.

EXAMPLE 5

Samples of aluminum alloy A6063 were pretreated as in the Example 1 and subjected to an electrolytic process in a bath containing 15 weight percent of sulphuric acid and 10 weight percent of glycerin for 20 minutes. The results are shown in Table V. It has been confirmed that similar results can be obtained with a bath containing about 50 weight percent of glycerin. As the amount of glycerin increases, it becomes possible to increase the peak voltage. It has been found that with glycerin content of 50 weight percent, it is possible to increase the peak voltage to as high as about 48 volts and to decrease the average current density to as low as about 2 A/dm². Table VI shows the test results as obtained with an electrolytic processing time of 30 minutes.

Table V

| Sample | Bath Temp. (° C) | Pulse Duration (m.sec.) | n | Peak Voltage (V) | Average Current Density (A/dm²) | Film Thickness (μ) | Colour |
|---|---|---|---|---|---|---|---|
| 1 | 15 ± 2 | 16 | 2 | 40 | 4.17 | 43 | Slightly light amber |
| 2 | 15 ± 2 | 16 | 3 | 40 | 4.43 | 37 | amber |
| 3 | 15 ± 2 | 16 | 4 | 40 | 2.81 | 30 | Slightly rich amber |
| 4 | 15 ± 2 | 33 | 2 | 40 | 4.87 | 45 | amber |
| 5 | 15 ± 2 | 33 | 3 | 40 | 3.93 | 28 | Slightly rich amber |

Table VI

| Sample | Bath Temp. (° C) | Pulse Duration (m.sec.) | n | Peak Voltage (V) | Average Current Density (A/dm²) | Film Thickness (μ) | Colour |
|---|---|---|---|---|---|---|---|
| 1 | 15 ± 2 | 16 | 2 | 40 | 4.17 | 62 | slightly light bronze |
| 2 | 15 ± 2 | 16 | 3 | 40 | 4.43 | 49 | bronze |
| 3 | 15 ± 2 | 16 | 4 | 40 | 2.81 | 43 | Slightly rich bronze |
| 4 | 15 ± 2 | 33 | 2 | 40 | 4.87 | 66 | bronze |
| 5 | 15 ± 2 | 33 | 3 | 40 | 3.93 | 42 | bronze |

EXAMPLE 6

Samples of aluminum alloy A6063 were pretreated as in the Example 1 and subjected an electrolytic process for 20 minutes in a bath of sulphuric acid-water solution containing 3 g/l of aluminum ion ($Al^{+++}$). The results are shown in Table VII. It has been found that as long as the aluminum ion is less than 5 g/l, the amount does not influence on the results shown in Table VII. Table VIII shows the test results obtained by the electrolytic processing time of 30 minutes.

Table VII

| Sample | Bath Temp. (° C) | Pulse Duration (m.sec.) | n | Peak Voltage (V) | Average Current Density (A/dm²) | Film Thickness (μ) | Colour |
|---|---|---|---|---|---|---|---|
| 1 | 15 ± 2 | 16 | 2 | 40 | 4.16 | 42 | Light amber |
| 2 | 15 ± 2 | 16 | 3 | 40 | 4.43 | 36 | amber |
| 3 | 15 ± 2 | 16 | 4 | 40 | 2.80 | 29 | amber |
| 4 | 15 ± 2 | 33 | 2 | 40 | 4.86 | 44 | Slightly light amber |
| 5 | 15 ± 2 | 33 | 3 | 40 | 3.91 | 27 | amber |

Table VIII

| Sample | Bath Temp. (° C) | Pule Duration (m.sec.) | n | Peak Voltage (V) | Average Current Density (A/dm²) | Film Thickness (μ) | Colour |
|---|---|---|---|---|---|---|---|
| 1 | 15 ± 2 | 16 | 2 | 40 | 4.16 | 61 | Light bronze |
| 2 | 15 ± 2 | 16 | 3 | 40 | 4.43 | 48 | Slightly light bronze |
| 3 | 15 ± 2 | 16 | 4 | 40 | 2.80 | 43 | bronze |
| 4 | 15 ± 2 | 33 | 2 | 40 | 4.86 | 65 | Slightly light bronze |
| 5 | 15 ± 2 | 33 | 3 | 40 | 3.91 | 41 | bronze |

EXAMPLE 7

Samples of aluminum alloy A6063 were pretreated as in the Example 1 and subjected to an electrolytic process for 20 minutes with an electrolyte of sulphuric acid-water solution containing 5 weight percent of oxalic acid. The results are shown in Table IX.

The addition of oxalic acid is effective to suppress dissolving of the film and enhances the production of coloured anodic film. The amount of oxalic acid which can be dissolved in the water solution of sulphuric acid is dependent on the bath temperature, and the maximum value is about 5 percent at 10° C. and about 7 percent at 15° C. Therefore, the amount of addition the oxalic acid must be within the aforementioned value. Table X shows the test results obtained with the electrolytic processing of 30 minutes.

Table IX

| Sample | Bath Temp. (° C) | Pulse Duration (m.sec.) | n | Peak Voltage (V) | Average Current Density (A/dm²) | Film Thickness (μ) | Colour |
|---|---|---|---|---|---|---|---|
| 1 | 15 ± 2 | 16 | 2 | 40 | 4.17 | 43 | Slightly light amber |
| 2 | 15 ± 2 | 16 | 3 | 40 | 4.44 | 38 | Amber |
| 3 | 15 ± 2 | 16 | 4 | 40 | 2.81 | 30 | Slightly rich amber |
| 4 | 15 ± 2 | 33 | 2 | 40 | 4.85 | 45 | amber |
| 5 | 15 ± 2 | 33 | 3 | 40 | 3.92 | 28 | amber |

Table X

| Sample | Bath Temp. (° C | Pulse Duration (m.sec.) | n | Peak Voltage (V) | Average Current Density (A/dm²) | Film Thickness (μ) | Colour |
|---|---|---|---|---|---|---|---|
| 1 | -± 2 | 16 | 2 | 40 | 4.17 | 62 | Slightly light |

Table X-continued

| Sample | Bath Temp. (° C) | Pulse Duration (m.sec.) | n | Peak Voltage (V) | Average Current Density (A/dm²) | Film Thickness (μ) | Colour |
|---|---|---|---|---|---|---|---|
| | | | | | | | bronze |
| 2 | 15 ± 2 | 16 | 3 | 40 | 4.44 | 50 | bronze |
| 3 | 15 ± 2 | 16 | 4 | 40 | 2.81 | 44 | Slightly rich bronze |
| 4 | 15 ± 2 | 33 | 2 | 40 | 4.85 | 66 | bronze |
| 5 | 15 ± 2 | 33 | 3 | 40 | 3.92 | 41 | bronze |

As described in connection with the Examples 5 through 7, by adding an electrical conductivity control agent such as glycerin, aluminum ion, oxalic acid, polyethylene glycol, boracic acid, or tartaric acid into the electrolyte comprising water solution of sulphuric acid, it becomes possible to perform an electrolytic process with low level current and high voltage without having the risk of producing cracks in the anodized film. The addition of such a control agent is also effective to produce a coloured film with a relatively short processing time. It has been found that glycerin is particularly effective to prevent cracks in the film.

It has also been found that specific compositions of aluminum alloy are effective to perform a low current, high voltage electrolytic process. The following are examples of such processes.

EXAMPLE 8

Aluminum alloy materials (1) through (7) containing zinc and magnesium at ratios as set forth in Table XI have been pretreated as in the Example 1 and subjected to electrolytic process in a bath of 15 weight percent of sulphuric acid under the conditions as shown in the Table XI to produce anodized films. The results are also shown in the Table.

From Table XI, it will be seen that, as the ratio of zinc to magnesium increases, the goldish colour is intensified and, when the ratio becomes less than one, the gray colour is intensified. Further, it has been found that in this process the peak voltage of the pulse can be increased beyond 35 volts which has been believed to be maximum limit of the pulse voltage in conventional electrolytic processes using a sulphuric acid solution. Thus, in this process, it is possible to decrease the processing time and produce a wide variety of colours.

Table XI

| Sample | Zn/Mg | Peak Voltage (V) | Average current density (A/dm²) | Pulse Duration (m.sec.) | n | Bath Temp. (° C) | Process time | Colour | Colour Difference NBS |
|---|---|---|---|---|---|---|---|---|---|
| 1 | 0.05 | 39.5 - 40 | 2.1 - 1.0 | 16 | 3 | 10 ± 1 | 20 | yellowish gray | 25.8 |
| 2 | 0.01 | 36.5 - 37.5 | 2.3 - 1.4 | 16 | 3 | 10 ± 1 | 20 | yellowish gray | 18.9 |
| 3 | <<0.01 | 35 - 35.5 | 2.3 - 1.5 | 16 | 3 | 10 ± 1 | 20 | yellowish gray | 20.1 |
| 4 | 8.63 | 39 - 40 | 2.0 - 1.3 | 16 | 3 | 10 ± 1 | 20 | whitish gold | 30.6 |
| 5 | 3.41 | 40.5 - 41.5 | 1.8 - 0.9 | 16 | 3 | 10 ± 1 | 10 | grayish gold | 29.4 |
| 6 | 2.24 | 40.5 - 42 | 1.9 - 0.9 | 16 | 3 | 10 ± 1 | 20 | silver gold | 34.7 |
| 7 | 1.86 | 40.5 - 41 | 1.9 - 1.2 | 16 | 3 | 10 ± 1 | 20 | grayish gold | 32.9 |

From the above descriptions, it will be apparent that, in accordance with the present invention, there is provided a method in which coloured anodic films can be produced through electrolytic processes using sulphuric acid electrolyte. In accordance with the present invention, it is possible to obtain anodized films which are uniformly coloured and have superior mechanical properties.

It should particularly be noted that the present invention is advantageous from the viewpoint of economy because the process can be performed by simply adding an n-value controllable pulse generating device to a conventional apparatus which has been employed for conventional electrolytic processes using sulphuric acid electrolyte. Since a sulphuric acid electrolytic process is less expensive and since sulphuric acid is chemically stable, the method in accordance with the present invention can be economically and safely performed. The coloured films as produced in accordance with the present invention have superior properties and the colour or other properties are very stable.

We claim:

1. A method for producing a coloured anodic film on the surface of an aluminum material which comprises:

electroloyzing the aluminum material in a sulphuric acid electrolyte bath containing a resistivity control agent comprising from 3 to less than 5 grams per liter of water soluble, trivalent aluminum ions, by applying to the aluminum material a pulsating electric current characterized by having a current density between 2 and 8 A/ dm2, a peak voltage of 25 to 45 volts, a pulse duration of 5 to 70 m.sec., and a ratio of pulse frequency to pulse duration of between 2 and 7, wherein the aluminum material includes zinc and magnesium, the ratio of zinc to magnesium being less than 5.

2. A method according to claim 1 wherein the pulse duration is from 10 to 45 m.sec., and the ratio of pulse frequency to pulse duration is between 3 and 5.

* * * * *